US010928168B2

(12) United States Patent
Graber

(10) Patent No.: US 10,928,168 B2
(45) Date of Patent: Feb. 23, 2021

(54) NOISE CONTROL SYSTEM AND METHOD FOR SMALL CALIBER AMMUNITION

(71) Applicant: Curtis E. Graber, Woodburn, IN (US)

(72) Inventor: Curtis E. Graber, Woodburn, IN (US)

( * ) Notice: Subject to any disclaimer, the term of this patent is extended or adjusted under 35 U.S.C. 154(b) by 0 days.

(21) Appl. No.: 16/185,554

(22) Filed: Nov. 9, 2018

(65) Prior Publication Data

US 2019/0145745 A1 May 16, 2019

Related U.S. Application Data

(60) Provisional application No. 62/584,239, filed on Nov. 10, 2017.

(51) Int. Cl.
*F42B 10/34* (2006.01)
*F42B 5/02* (2006.01)
*F42B 10/40* (2006.01)

(52) U.S. Cl.
CPC ..... *F42B 10/34* (2013.01); *F42B 5/02* (2013.01); *F42B 10/40* (2013.01)

(58) Field of Classification Search
CPC .. F42B 5/02; F42B 10/28; F42B 10/32; F42B 10/34; F42B 10/38; F42B 10/40; F42B 10/42; F42B 10/668; F42B 12/36; F42B 12/46
USPC ..... 102/439, 503
See application file for complete search history.

(56) References Cited

U.S. PATENT DOCUMENTS 2,090,533 A * 8/1937 Howdeshell ..... F42B 10/34 244/3.1
2,247,111 A * 6/1941 Batchelor ..... F42B 12/36 102/501
3,086,467 A * 4/1963 Gallagher ..... F42B 10/52 244/3.1
3,259,065 A * 7/1966 Ross ..... F42B 10/38 244/3.1
3,345,948 A * 10/1967 Sarvis ..... F42B 10/40 102/513
3,545,212 A * 12/1970 Ludwig ..... F42B 10/42 60/768
3,620,484 A * 11/1971 Fritz Schoppe ..... B64C 30/00 244/130
3,672,304 A * 6/1972 Rogers ..... F42B 10/38 102/516
4,353,303 A * 10/1982 Bell ..... F42B 12/50 102/334
4,917,335 A * 4/1990 Tidman ..... B64C 23/00 102/490
5,275,110 A * 1/1994 Flatau ..... F42B 30/02 102/503
6,883,747 B2 * 4/2005 Ratkovic ..... F41G 7/346 244/3.1
9,429,406 B2 * 8/2016 Harrison ..... F42B 14/02
10,030,951 B2 * 7/2018 Flynn ..... F42B 10/666

(Continued)

FOREIGN PATENT DOCUMENTS

WO WO-2014195683 A1 * 12/2014 ..... F42B 10/40
WO WO-2016131158 A2 * 8/2016 ..... F42B 12/38

*Primary Examiner* — Stephen Johnson
*Assistant Examiner* — Benjamin S Gomberg
(74) *Attorney, Agent, or Firm* — Taylor IP, P.C.

(57) ABSTRACT

A projectile including a body having a tip and a tail, the body also having an internal cavity. There is at least one plume aperture connected to the internal cavity, the plume aperture being positioned proximate to the tip of the body.

18 Claims, 2 Drawing Sheets

(56) References Cited

U.S. PATENT DOCUMENTS

| | | | | |
|---|---|---|---|---|
| 10,094,644 | B2 * | 10/2018 | Ziegler | F42B 10/38 |
| 10,435,135 | B2 * | 10/2019 | Janeke | B64C 30/00 |
| 2007/0272111 | A1 * | 11/2007 | Saxby | F42B 5/02<br>102/444 |
| 2018/0023932 | A1 * | 1/2018 | Muster | F42B 12/38<br>102/439 |

* cited by examiner

NOISE CONTROL SYSTEM AND METHOD FOR SMALL CALIBER AMMUNITION

CROSS REFERENCE TO RELATED APPLICATIONS

This is a non-provisional application based upon U.S. provisional patent application Ser. No. 62/584,239, entitled "NOISE CONTROL SYSTEM AND METHOD FOR SMALL CALIBER AMMUNITION", filed Nov. 10, 2017, which is incorporated herein by reference.

BACKGROUND OF THE INVENTION

1. Field of the Invention

The present invention relates to ammunition and specifically to projectiles that travel faster than the speed of sound.

2. Description of the Related Art

Nearly all mechanical weapon systems require some form of ammunition in order to operate. The term "ammunition" is traced back to the mid-17th century, with the word coming from the French la munition, which can be understood to mean the material used for war. The term is now used to refer to the cartridges used in rifles, pistols, handguns, and machine guns and the like, regardless of the purpose for which it is used.

The purpose of ammunition is to project a kinetic force against a selected target to have an effect. The firearm cartridge is a single package that includes all of the components required for the firearm to deliver a projectile to a target.

Ammunition comes in a great range of sizes and types and is often designed to work only in specific weapons systems. This fact has allowed some manufacturers of thus control interchangeability of components. For example, Germany produced Mauser rifles (in the last century) that would accept unique cartridges that were sold to specific countries, thus allowing control of the other countries ability to easily interact with and exchange weapons with others. However, now there are internationally recognized standards for certain ammunition types that enable the use of the standardized ammunition across different weapons and by different users. Specific types of ammunition are designed to have a specialized effect on a target, such as armor-piercing shells to pierce armor and tracer ammunition to leave a visual trail for weapon aiming purposes.

The projectiles of the ammunition can be shaped and have various layers to enhance the expansion of the projectile inside the target, to maximizing the damage inflicted by a single round. Anti-personnel shells fragment into many pieces in the target and can affect a large area of a body. Armor-piercing rounds are specially designed to penetrate armor using a penetrator rod, or a shaped explosive or exothermic material to breach a layer of armor.

While not all ammunition types have a cartridge case. The discussion herein will assume that it does, with the focus of the invention being on the projectile.

The projectile is the part of the ammunition that leaves the barrel of a weapon and impacts the target. The effect on the target by the projectile is usually either kinetic (a standard bullet) or through the delivery of explosives in a portion of the projectile.

A bullet is the kinetic projectile, discussed above, and it is that component of ammunition that is expelled from the gun barrel during shooting. Bullets are made of a variety of materials such as copper, lead, steel, bismuth, polymer, rubber, wax or even special materials such as silver and alloys. Bullets are manufactured in a large number of shapes and constructions depending on the intended applications, such as hunting, target shooting, training and combat. The shapes and materials impact the air drag, and flight characteristics of the bullet.

Though the word "bullet" is often used incorrectly to refer to a firearm cartridge, a bullet is not the complete cartridge, but rather a component of the cartridge. A round of ammunition or the cartridge is a combination package of the bullet (which is the projectile), the case (which holds everything together), the propellant (which provide the majority of the energy to launch the projectile) and the primer (which ignites the propellant in the case).

The bullets used in many weapon systems are fired at muzzle velocities that are faster than the speed of sound, which is about 1,130 ft./sec. (343 m/sec) in dry air at 68° F., at sea level air pressure, and thus can travel a substantial distance to a target before a nearby observer hears the sound of the shot. The sound of gunfire, sometimes referred to as the muzzle report, is often accompanied with a loud bull-whip-like crack as the bullet pierces through the air at a supersonic velocity to thereby create a sonic boom. The sonic boom is a combination of a compression of air and a rebounding partial vacuum that gives the noise the double crack sound. Bullet speeds at various stages of flight depend on intrinsic factors such as its sectional density, aerodynamic profile and ballistic coefficient, and extrinsic factors such as barometric pressure, humidity, air temperature and wind speed. One way of eliminating the sonic boom is to fire the projectile at a subsonic velocity so that there is no sonic boom. This means that a subsonic cartridge, such as .45 ACP, can be substantially quieter than a supersonic cartridge such as the .223 Remington, even without the use of a suppressor.

What is needed in the art is a way to reduce or eliminate the sonic boom for projectiles fired at high velocities.

SUMMARY OF THE INVENTION

The present invention provides a quieter version of a high speed projectile.

The present invention in one form is a projectile including a body having a tip and a tail, the body also having an internal cavity. There is at least one plume aperture connected to the internal cavity, the plume aperture being positioned proximate to the tip of the body.

The present invention in another form is directed to a firearm cartridge having a casing and a projectile including a body having a tip and a tail, the body also having an internal cavity. There is at least one plume aperture connected to the internal cavity, the plume aperture being positioned proximate to the tip of the body.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
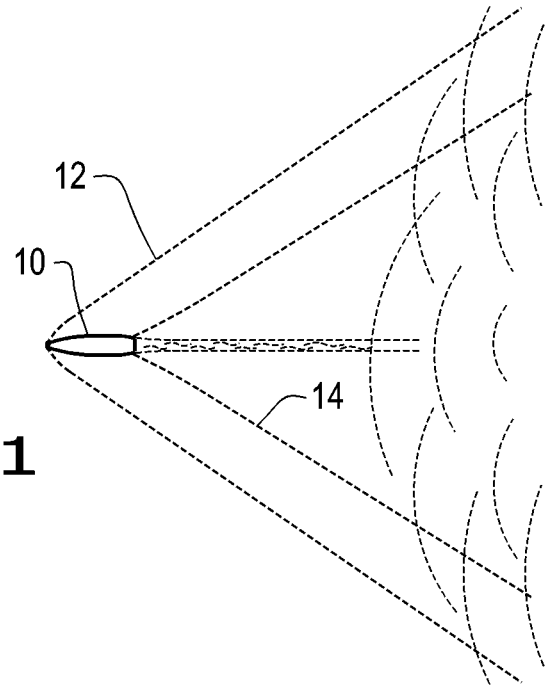
PRIOR ART FIG. 1
FIG. 1 is an illustration of a shock wave of a supersonic projectile.

Referring now to the drawings, and more particularly to FIG. 1, all common projectiles (such as projectile 10) and bodies of mass travelling faster than the speed of sound generate an acoustic shockwave comprised of a high-pressure bow wave 12 and a low-pressure stern wave 14 of the body in motion through the air. FIG. 1 is a Schlieren image of a supersonic projectile 10. The generated Shockwave is audible often times for miles and detrimental in many ways specifically in the use of small arms for covert applications due to the potential of observers or listening devices utilizing the sonic signature in an ability to detect and even localize the general or even direct position of the weapon used.

What is needed is a small arms projectile that can carry with itself a means to acoustically cloak, diminish or modify the shockwave 12, 14 generated to make the resulting signature ambiguous in the environment or to create a further usable distance to an observer or sensor array before discovery and determination of localization can be made with efficient and accurate results.

Active and passive acoustic cancellation methodologies are well known in some markets specifically within fixed and captive acoustic fields such as localized headphones where an "active anti-phase source" can generate a near cancellation of the acoustic challenge up to some limit of frequency and amplitude which is generally processing power and time arrivals limited to about 15-265 hz based upon the general headphone applications this coupled with passive noise absorption provides a virtual area of silence for the user of the headset for comfort and better audibility of the music or voice source material listened to.

Due to the different conditions and dynamically changing phase relative to a position of an observer or sensor array of a bullet in motion the inability to utilize a similar active and or passive methodology is simply not likely due to limitations of 1. Size 2. Weight 3. Acoustic inefficiency of small transducers etc.

A better solution is to look at the mechanics of how such a shockwave 12, 14 is generated with a high velocity projectile 10 and to modify the conditions of the mechanics of its acoustic signature generation process. It is widely known that the density of air (thus temp, humidity and air pressure) sets the speed of threshold for the on-set of the phenomena of shockwave generation, thus if one can modify the density of the envelope of air around the tip of the projectile in flight, a modification or even obfuscation of the acoustic signature is realizable.

In practical flight envelopes of aircraft/missiles/rockets it is known to the industry that at a very high-altitude flight-path and the resulting very low air density of such high altitudes produces greatly diminished shockwaves of a vehicle at supersonic speed, if one can replicate the conditions localized just around the projectile we can assume the conditions of the shockwave generation to be modifiable and not a fixed constant as is currently believed and expected.

Figure 2:
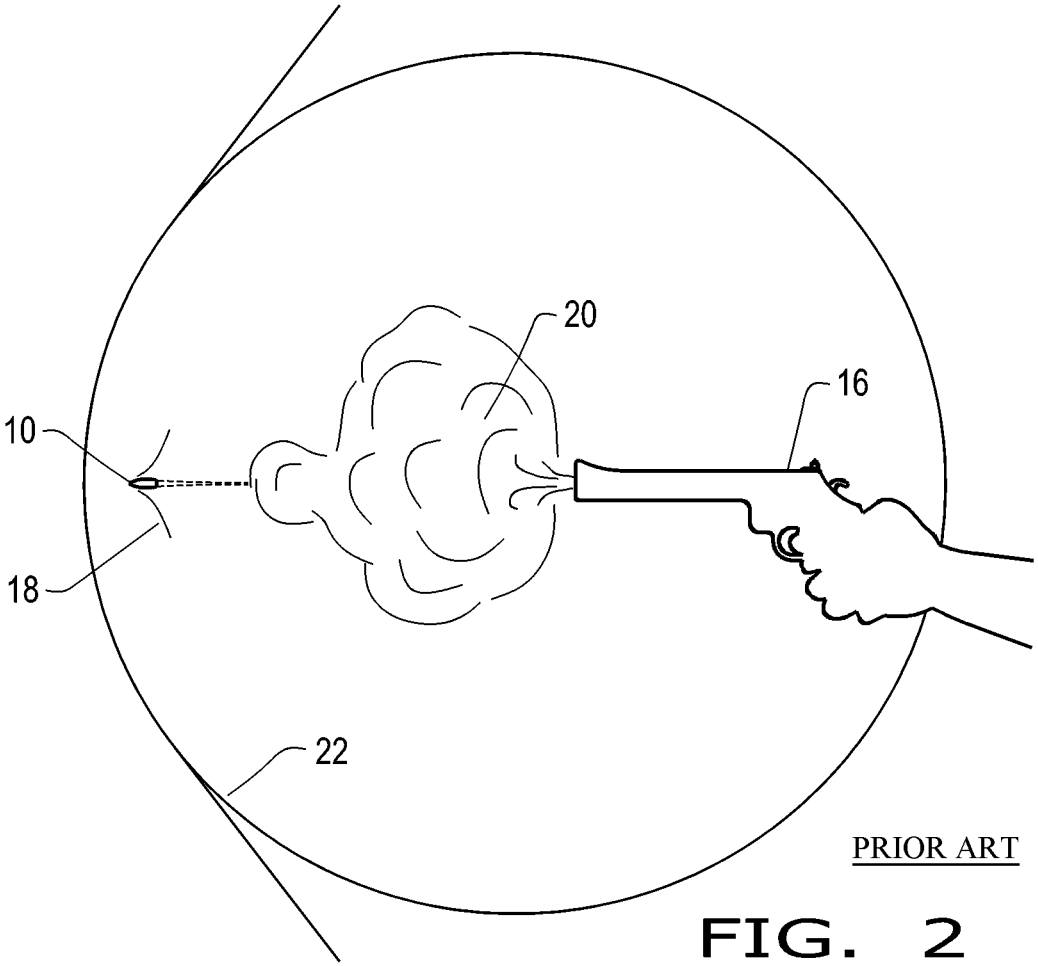
PRIOR ART FIG. 2
FIG. 2 is an illustration of a flight path of another projectile.

Now, additionally referring to FIG. 2 there is shown a Schlieren image of a supersonic projectile 10, having been fired from a weapon system 16, exiting a high heat zone 20 and starting to develop a shockwave 18 as projectile 10 leaves heated area 20. A muzzle blast concussion 22 can also be seen in FIG. 2.

Figure 3:
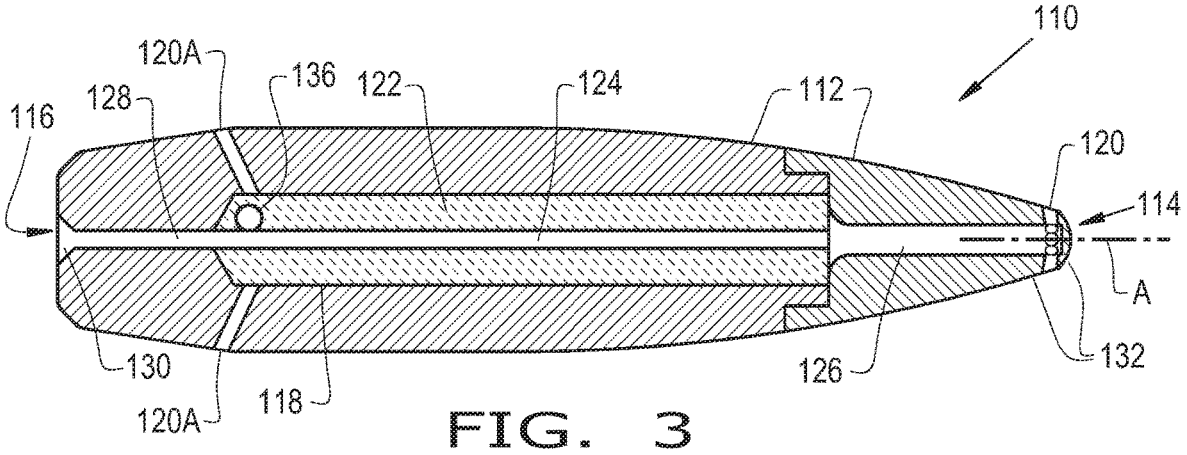
FIG. 3 is a cross sectional view of an embodiment of a projectile of the present invention.

Now, additionally referring to FIG. 3, there is illustrated an embodiment of a projectile 110 of the present invention shown in cross sectional form. Projectile 110 includes a body 112 having a tip 114 and a tail 116. Body 112 also has an internal cavity 118 and plume apertures 120 connected to internal cavity 118. Plume apertures 120 are positioned proximate to tip 114.

Plume apertures 120 are equally spaced around the tip 114 and an axis A. There is a fluid connection or pathway the couples plume apertures 120 to an exothermic compound 122 in cavity 118. Exothermic compound 122 is uniformly distributed in cavity 118 about axis A of body 112. The exothermic compound 122 has an open core 124 that passes to plume apertures 120 by way of plume exhaust path 126. Body 112 further includes an ignition port 128 extending from the open core 124 to tail 116 of body 112. An ignition delay compound 130 is positioned in a portion of the ignition port 128 so that exothermic compound 122 will not be ignited until projectile 110 has traveled at least a portion of its path in the barrel of a weapon, and may even delay the ignition until projectile 110 has left the muzzle of the barrel.

Body 112 also has a laminar flow blending area 132 located between the tip and an area that extends toward tail 116 past the plume apertures 120. Similar to plume apertures 120 that are proximate to tip 114, at the aft end 116 plume apertures 120A are positioned with passageways that extend to cavity 118. Plume 134A is formed to mitigate the formation of the trailing negative pressure wave 14 of the prior art. Both plumes 134 and 134A are illustrated with curly lines, but a laminar smooth flow is what occurs.

It is contemplated that ports 120 and 120A may have their positions shifted forward or aft along the outer surface of projectile 110 to optimize the effect of plumes 134 and 134A depending on the shape of projectile 110. It is also contemplated that only one set of plume apertures 120 or 120A may be used in specific instances depending upon the acoustic signature modification needs.

Ball 136 is cast in place in exothermic compound 122, as is shown in FIG. 3, and is quickly freed as the exothermic compound 122 is converted to nitrogen gas allowing the ball 136 to move back to close off port 128 where it enters chamber 118. Port 116 has a second compound filling the core burner design, which is ignited by the compound facing the gun powder in the case, this triggering compound, could be a black powder or equivalent other fast burn compound that provides the very brief delayed ignition to allow the bullet 110 to leave the barrel prior to outgassing of the exothermic gas from the compound core burner grain 122. It is also contemplated that the inner portion of the passageway coupled to aperture 120A would not be blocked by exothermic compound grain 122.

Figure 4:
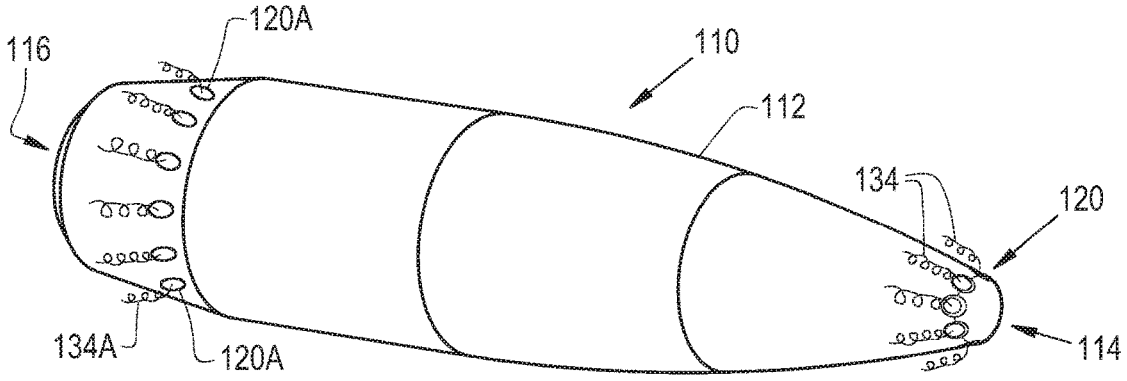
FIG. 4 is a perspective view of the projectile of FIG. 3.
Figure 5:
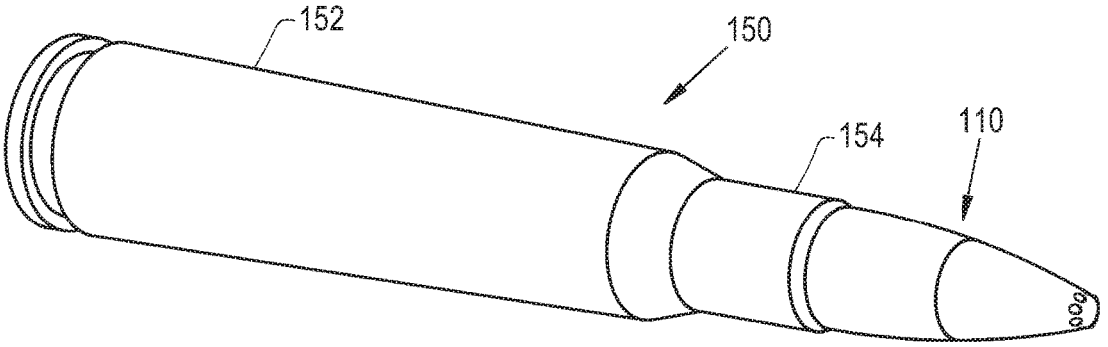
FIG. 5 is a perspective view of a round of ammunition with the projectile of FIGS. 3 and 4.

Now, additionally referring to FIGS. 4 and 5, Applicant has studied the challenge and has invented projectile 110 that contains a exothermic core burning gas generator section 122 that exhausts a super-heated plume 134 at or near the tip 114 of the projectile 110 at 90-120 degrees to the direction of flight. The present invention generates a symmetric plume, and a laminar flow shaped or sculpted blending area 132 is used around the bullet tip 114, to create a virtual thin-walled 'straw' of super-heated air that envelopes the projectile 110 during flight and significantly raises the thermal constant within the envelope, which serves to replicate the conditions of lower air density "high altitude" flight producing a modified acoustic signature.

Many suitable exothermic materials are known to the industry, one possible choice could be a Sodium-Azide (NaN3) compound that is commonly used in vehicle airbags as the nitrogen gas generator for safe and nearly instant inflation of the airbags during a crash scenario. The Sodium-Azide compound is a complex chemical reaction resulting in its final stage as super-heated gas and it is non-toxic to the environment, the reaction resulting in silica glass and produces a nontoxic, no-smoke, no-flash, volume of Nitrogen gas that has a temperature of greater than 300° C. (572° F. degrees). The expansion volume formula for Sodium Azide or NaN3 is generally accepted to be 1 gram of solid compound produces 0.5-0.75 liter volume of superheated nitrogen gas.

A quick volume requirement calculation confirmation of a thin-wall straw of superheated nitrogen of 500 yds. in length to be within relevant terms of fractional volume occupancy within the projectile.

A firearm cartridge 150 is depicted in FIG. 5, with projectile 110 positioned, as does any standard projectile, within the round's metallic casing 152 neck 154 with the propellant charge therein typical of standard rounds being captivated within the cartridge 150. The assembled round 150 is housed in standard magazines and fed into a conventional weapons chamber.

The weapons trigger is pulled and the firing pin strikes the primer of cartridge 150 initiating the propellant to combust and burn. The resulting heated gas begins the bullet 110 acceleration down the weapon barrel and simultaneously initiates the rear facing ignition compound 130 with a fixed chemical reaction delay set to the time required for the bullet to leave the weapon's barrel.

The Exothermic core burner 122 is initiated just as bullet 110 emerges from the barrel producing a spherically symmetric plume 134 of super-heated nitrogen gas that due to the bullet 110 velocity produces a very thin-walled virtual straw within which bullet 110 travels, with the plume emanating from apertures 120, 120A modifying the effective air temperature at the bullet tip 114 and tail 116 to increase up to 500 degrees above the ambient temperature, which serves to create a significant decrease in the localized air density exactly where the shockwave would have been generated and modifies and diminishes the resulting acoustic shockwave (report) that corresponds to a high altitude (low air density) flight path all the while it is actually flying within typical air density and temperature of sea-level to its intended target. Further, the bullet 110 revolutions, caused by the rifling of the barrel, is contributory to the creation of the virtual heated gas straw sheath for the bullet 110 to travel within.

While in the present example the exothermic compound utilized produces a volume of super-heated nitrogen or other inert colorless gas, with Sodium-Azide, it is contemplated that other alternate chemistry exothermic compounds can be used to meet the objectives.

At the tip of the projectile a plume aperture array 120 is arranged around the tip 114 to produce a symmetric fully encompassing plume around the projectile 110. The triggering of the exothermic compound 122 is delayed until the bullet 110 reaches the barrel muzzle by way of a delayed reaction if needed.

The bullet mass, as can be assumed from the view of FIG. 3, is effected by the exothermic core burner 124 and plume passageways 126, which will slightly decrease the bullet specific mass however a slightly longer bullet could be selected to allow for an identical bullet mass so as to not diminish or impact the trajectory or foot pounds of energy delivered to the target as a result.

While the Super-heated plume 134 may be discoverable with highly sensitive Infrared sensors, the super-heating of the plume has a very short lifetime (fractions of a second) with it being distributed over the trajectory of the projectile, and the air quickly returns to the ambient temperature.

The side aperture plume 134 generation over the bullet trajectory should remain constant as compared to an identical unmodified cartridge fired from the same weapons platform and minimal added drag from the shape of the bullet is realized. Compatibility with current weapon systems is achieved with the present invention, with FIG. 5 representing a configuration using a standard shell casing 152.

It is also contemplated that a small non-combustible element 136, such as a ball 136, may be included in the aft portion of the exothermic core 122 so that once the material around the element 136 burns away the element 136 will move to plug the ignition port 128 as the projectile 110 is in flight.

There are several advantages of the present invention, which include an anticipated significant increase in the air temperature surrounding the tip of the air penetrating supersonic bullet, which could result in a lower intrinsic ballistic drag coefficient value of a projectile resulting in a longer than standard range as compared to a conventional shaped and weight bullet and cartridge power for the same weapons platform.

The cost per finished round could be similar to common tracer-rounds and a slight premium to conventional bullets; however, the baseline mechanics of the Thermal Acoustic Obfuscation (TAO) solution of the present invention should be relatively low-cost once production maturity is reached.

The cartridge of the present invention results in a round that is weapons platform compatible so no changes of the weapons platform or any already in use magazines or accessories need to be replaced or modified for use with the new round.

Range of the thermal obfuscation phenomena is limited to the duration of the exothermic reaction and volume of expendable compound material carried within the bullet, it is possible that the smaller bullet platforms can only carry enough exothermic compound to render the bullet thermally obfuscated for a range of 500-600 yds. beyond which the bullet would return to generating an acoustic signature from the naturally generated and un-modified shockwave.

Initial weapon calibers studied include the 5.56 mm and 7.62 mm, Larger weapons platform rounds such as the .50 BMG may have enough volume to accomplish miles of useable range in a Thermal Acoustic Obfuscated condition.

Advantageously the projectile solution of the present invention when combined with muzzle suppresser technology could render a high velocity weapons platform virtually covert.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A projectile, comprising:

a body having a tip and a tail, the body also having an internal cavity and an ignition port;

at least one plume aperture connected to the internal cavity, the plume aperture being positioned proximate to the tip of the body;

an exothermic compound in the cavity; and a non-combustible element positioned in the exothermic compound that releases therefrom to plug the ignition port after a portion of the exothermic compound is burnt away from the non-combustible element.

2. The projectile of claim 1, wherein the at least one plume aperture is a plurality of plume apertures positioned around the body proximate to the tip.

3. The projectile of claim 2, wherein the plume apertures are equally spaced around the tip.

4. The projectile of claim 1, wherein the exothermic compound is uniformly distributed in the cavity about an axial axis of the body.

5. The projectile of claim 4, wherein the exothermic compound has an open core passing to the at least one plume aperture.

6. The projectile of claim 5, wherein the ignition port extends from the open core to the tail of the body.

7. The projectile of claim 6, further comprising an ignition delay compound positioned in the ignition port.

8. The projectile of claim 6, wherein the body has a plume exhaust pathway positioned between the cavity and the at least one plume aperture.

9. The projectile of claim 1, further comprising a laminar flow blending area located between the tip and beyond the at least one plume aperture.

10. A firearm cartridge, comprising:

a casing having at least one opening;

propellant within the casing; and a projectile extending from the opening in the casing, the projectile having:

a body having a tip and a tail, the body also having an internal cavity and an ignition port;

at least one plume aperture connected to the internal cavity, the plume aperture being positioned proximate to the tip of the body;

an exothermic compound in the cavity; and a non-combustible element positioned in the exothermic compound that releases therefrom to plug the ignition port after a portion of the exothermic compound is burnt away from the non-combustible element.

11. The firearm cartridge of claim 10, wherein the at least one plume aperture is a plurality of plume apertures positioned around the body proximate to the tip.

12. The firearm cartridge of claim 11, wherein the plume apertures are equally spaced around the tip.

13. The firearm cartridge of claim 10, wherein the exothermic compound is uniformly distributed in the cavity about an axial axis of the body.

14. The firearm cartridge of claim 13, wherein the exothermic compound has an open core passing to the at least one plume aperture.

15. The firearm cartridge of claim 14, wherein the ignition port extends from the open core to the tail of the body.

16. The firearm cartridge of claim 15, further comprising an ignition delay compound positioned in the ignition port.

17. The firearm cartridge of claim 15, wherein the body has a plume exhaust pathway positioned between the cavity and the at least one plume aperture.

18. The firearm cartridge of claim 10, further comprising a laminar flow blending area located between the tip and beyond the at least one plume aperture.

* * * * *